US009339867B2

(12) United States Patent
Bültermann

(10) Patent No.: US 9,339,867 B2
(45) Date of Patent: May 17, 2016

(54) DEVICE, SYSTEM AND METHOD FOR DIE-CASTING METALLIC MATERIAL IN THE THIXOTROPIC STATE

(71) Applicant: Mold-Thix-Consulting Bueltermann GmbH, Graz-Weinitzen (AT)

(72) Inventor: Bernd Bültermann, Graz-Weinitzen (AT)

(73) Assignee: Mold-Thix-Consulting Bueltermann GmbH, Graz-Weinitzen (AT)

( * ) Notice: Subject to any disclaimer, the term of this patent is extended or adjusted under 35 U.S.C. 154(b) by 0 days.

(21) Appl. No.: 14/357,087

(22) PCT Filed: Nov. 2, 2012

(86) PCT No.: PCT/AT2012/050172
§ 371 (c)(1),
(2) Date: May 8, 2014

(87) PCT Pub. No.: WO2013/067567
PCT Pub. Date: May 16, 2013

(65) Prior Publication Data

US 2014/0311698 A1 Oct. 23, 2014

(30) Foreign Application Priority Data

Nov. 10, 2011 (AT) ..... A 1664/2011

(51) Int. Cl.

| | |
|---|---|
| ***B22D 17/20*** | (2006.01) |
| ***B22D 17/00*** | (2006.01) |
| ***B22D 17/30*** | (2006.01) |
| ***B22D 17/22*** | (2006.01) |

(52) U.S. Cl.
CPC ..... *B22D 17/2061* (2013.01); *B22D 17/007* (2013.01); *B22D 17/2281* (2013.01); *B22D 17/30* (2013.01)

(58) Field of Classification Search
CPC ..... B22D 17/30; B22D 17/32; B22D 17/007; B22D 17/2061; B22D 11/18; B22D 11/182; B22D 39/00
See application file for complete search history.

(56) References Cited

U.S. PATENT DOCUMENTS

| | | | | |
|---|---|---|---|---|
| 5,836,372 | A | 11/1998 | Kono | |
| 6,059,012 | A | 5/2000 | Vining et al. | |
| 6,840,302 | B1 * | 1/2005 | Tanaka et al. | 164/113 |
| 6,860,314 | B1 | 3/2005 | Koide et al. | |

(Continued)

FOREIGN PATENT DOCUMENTS

| | | | |
|---|---|---|---|
| DE | 10031087 | A1 | 1/2002 |
| DE | 10157349 | A1 | 6/2003 |

(Continued)

OTHER PUBLICATIONS

Austrian Office Action.
ISA Written Opinion for PCT/AT2012/050172.
International Preliminary Report on Patentability for International Application No. PCT/AT2012/050172 dated May 22, 2014.

*Primary Examiner* — Kevin P Kerns
*Assistant Examiner* — Steven Ha
(74) *Attorney, Agent, or Firm* — Hoffmann & Baron, LLP

(57) ABSTRACT

A device for die-casting metal material, including a screw unit for bringing the material into a thixotropic state and a cylinder/piston unit fed by the screw unit for applying pressure to the thixotropic material for the die casting, wherein a thermally controllable valve is arranged between the screw unit and the cylinder/piston unit.

26 Claims, 3 Drawing Sheets

(56) References Cited

U.S. PATENT DOCUMENTS

| | | | | |
|---|---|---|---|---|
| 2001/0045266 | A1 | 11/2001 | Kono | |
| 2002/0026995 | A1 * | 3/2002 | Kono | 164/113 |
| 2003/0094258 | A1 | 5/2003 | Hartmann et al. | |
| 2004/0151799 | A1 | 8/2004 | Gellert et al. | |
| 2006/0000572 | A1 | 1/2006 | Tanaka et al. | |
| 2008/0017345 | A1 * | 1/2008 | Weir | 164/113 |

FOREIGN PATENT DOCUMENTS

| | | | |
|---|---|---|---|
| DE | 10359692 | A1 | 7/2004 |
| EP | 0859677 | B1 | 3/2002 |
| GB | 2354471 | | 3/2001 |
| JP | 10015652 | A * | 1/1998 |
| WO | WO 2007028265 | A2 | 3/2007 |

* cited by examiner

DEVICE, SYSTEM AND METHOD FOR DIE-CASTING METALLIC MATERIAL IN THE THIXOTROPIC STATE

CROSS-REFERENCE TO RELATED APPLICATIONS

This application is a National Phase application of International Application No. PCT/AT2012/050172 filed Nov. 2, 2012 which claims priority to Austrian Patent Application No. A 1664/2011 filed Nov. 10, 2011, the disclosures of which are incorporated herein by reference.

BACKGROUND

The present invention relates to a device for die-casting metal material, comprising a screw unit for bringing the material into a thixotropic state and a cylinder/piston unit fed by the screw unit for applying pressure to the thixotropic material for the die casting. The invention further relates to a system for die-casting metal material in the thixotropic state, comprising such a device, and to a method for die-casting metal material in the thixotropic state with use of such a device.

When die-casting metal material in the thixotropic ("semi-solid") state, also referred to as "metal injection moulding" and known for example under the trade name Thixomolding®, diecast parts can be produced which have properties that are improved compared with parts formed in the conventional die-casting process. Here, the materials have to be brought to the transition temperature between the solid and the liquid phase, such that distributed crystallised constituents are embedded in contiguous melted regions ("thixotropic phase"). Due to the additional influence of shear forces, the crystalline structures of the solid constituents are reduced in size, and the viscosity of the material falls, which facilitates the injection of said material into the die-casting mould and allows precise die casting.

Metal injection moulding machines are known for example from EP 0 080 787. In accordance with this known prior art, metal material is heated in the screw chamber of a combined cylinder/reciprocating screw unit and is exposed to a shear load by rotating the reciprocating screw so as to bring the material into the thixotropic state. The rotation of the reciprocating screw simultaneously conveys the material from the screw chamber into the injection chamber of the cylinder/reciprocating screw unit arranged in front of the reciprocating screw, wherein the reciprocating screw retreats progressively in the cylinder. If a quantity of thixotropic material sufficient for the die casting is located in the injection chamber, the material is injected into a casting mould by applying pressure to the reciprocating screw by means of a hydraulic system. In order to prevent the thixotropic material from flowing back from the injection chamber into the screw chamber as a result of the high pressure during the injection, the tip of the reciprocating screw is equipped with a check valve. Such a valve is exposed to high loads as a result of the friction between the reciprocating screw and the cylinder wall, the high process temperatures inside the cylinder and the application of pressure. Due to its arrangement on the reciprocating screw, an uncontrolled valve is generally used, which leads to a loss of accuracy. The required short injection times in conjunction with the large mass of the reciprocating screw also place high demands on the hydraulic system and control elements thereof due to the inertias in conjunction with the mass accelerations.

DE 190 79 118 discloses a metal injection moulding machine which achieves a much smaller piston mass due to the separation of the screw unit and cylinder/piston unit. In such a machine the material is first brought in a screw unit (screw extruder) into the thixotropic state and thereby fed to a separate cylinder/piston unit, which performs the injection procedure. Here, the screw unit conveys the thixotropic material via a hot runner into a feed chamber in the cylinder arranged behind the piston. For injection, the piston is first retracted, the material passes through a check valve in the piston from the feed chamber into the injection chamber on the other side of the piston, and is injected into the die-casting mould as a result of the application of pressure to the piston. In this method too, the valve located in the piston is exposed to high loads; in addition, the piston moved during the injection procedure with closed check valve causes an undesirable, uncontrollable suction in the screw extruder via the hot runner.

A method is known from WO 2011/116838, in which a semi-solid metal strand is produced in an extruder and is transferred in portions by means of tongs into the feed chamber of a separate cylinder/piston unit.

US 2002/0053416, as an alternative, presents a direct feed from the screw unit via the hot runner into the injection chamber of the cylinder/piston unit. In such a configuration, the high injection pressure of the cylinder/piston unit passes directly back into the screw unit via the hot runner. This results in a backflow of thixotropic material into the screw unit to an extent that is virtually impossible to control, and consequently leads to injection of an undefined quantity of material into the die-casting mould with negative effects on the quality of the diecast part. At the same time, the screw unit and the overall mechanical and hydraulic systems thereof are subjected to repeated high pressure surges, which, in addition to the direct loading, also increases the level of wear.

WO 01/021343 describes a method for bringing a liquid metal alloy into the thixotropic state in a twin-screw extruder and for subsequent injection moulding by means of a cylinder/piston unit. The twin screw, by means of a very high rotational speed, is intended to limit a deposition and curing of the melt on the cooled wall of the extruder, and a controllable mechanical valve on the extruder is intended to prevent the melt from flowing out prematurely into the cylinder/piston unit. Such a valve with moving parts is highly stressed and at risk of failure due to the ongoing temperature fluctuations and the mechanical loads.

SUMMARY

The object of the invention is to create a device for die-casting metal material in the thixotropic state which overcomes the aforementioned disadvantages of the prior art.

This object is achieved in accordance with a first aspect of the invention with a device of the type mentioned in the introduction, which is characterised in that a thermally controllable valve is arranged between the screw unit and the cylinder/piston unit. Such a valve, which is arranged between the screw unit and injection chamber of the cylinder/piston unit, makes it possible on the one hand to release the material flow from the screw unit in a controlled manner when feeding the cylinder/piston unit and on the other hand to prevent a backflow of material from the cylinder/piston unit into the screw unit when applying pressure for the die casting. The material for the injection procedure can thus be metered accurately, and the screw unit is reliably protected against the high pressure in the cylinder of the cylinder/piston unit at the moment of injection. In addition, the cylinder chamber not filled by material can be filled with gas, in particular with inert gas, which prevents oxidation of the material and reduces the application of force for the die-casting hydraulic system. Since the valve is not arranged on the piston of the cylinder/piston unit, it is stressed to a significantly lesser extent and is only subjected to minor structural limitations.

The controllable valve is preferably formed by a connection channel, which is equipped with controllable means for forced cooling of the material located therein until said material is below the solidification temperature thereof. As a result, there are no mechanical valve parts in the material flow when feeding the cylinder/piston unit by means of the screw unit, which significantly reduces the load on the valve and increases the service life thereof. Such a valve can also be constructed without moving parts, such that maintenance and wear of conventional valves are spared. The actual blocking function of the valve is performed quite simply by allowing the material in the connection channel to solidify.

It is particularly advantageous if the connection channel is widened in the direction of the cylinder/piston unit. Such a widening can be conical or stepped. The material solidified in the connection channel thus forms a form-fitting plug there, which reliably keeps the high injection pressures of the cylinder-piston unit away from the screw unit.

In order to make the connection channel continuous again for new material once an injection procedure has been performed, the connection channel is particularly preferably also equipped with controllable means for heating the material located therein. Once the connection channel has been heated such that the material therein can flow, the cylinder/piston unit can be fed thixotropic material from the screw unit for a further die casting.

In accordance with a further preferred embodiment of the invention, the screw unit and the cylinder/piston unit form a gap therebetween, said gap, except for any possible thermal insulators, being bridged only by the valve. This enables a thermal decoupling of the screw unit and cylinder/piston unit and thus allows an independent temperature control in the screw unit and in the cylinder/piston unit. In addition, the accessibility of the valve is facilitated, said valve preferably being fastened detachably at one of its two ends to the screw unit on the one hand and at the other of its two ends to the cylinder/piston unit on the other hand. The detachability of the fastening makes it possible to exchange the valve independently of the screw unit and cylinder/piston unit.

As described, the valve is preferably a connection channel with coolants for forced cooling, but could also be formed as a conventional valve having a mechanically closable connection channel between the screw unit and cylinder/piston unit. The valve is particularly preferably formed in a pipe section, which engages via end flanges in connection openings in the screw unit on the one hand and in the cylinder/piston unit on the other hand.

Here, it is particularly favourable if the pipe section is fixed by means of threaded rings into the connection openings, the threaded rings engaging via outer threads with inner threads of the connection openings and being cut in the axial direction. Such a flange connection ensures a secure, pressure-tight fit of the valve in the screw unit on the one hand and in the cylinder/piston unit on the other hand. In addition, the fit can be detached quickly by just one threaded ring on each flange. Due to the preferred cutting of the threaded rings in the axial direction, the valve furthermore can be inserted first into the respective connection opening, and the respective threaded ring, including the pipe section, can then be fitted and fixed, bit by bit. Due to this design, the threaded rings are not fixed component parts of the valve or of the pipe section and can therefore be handled and reused independently of the valve.

It is particularly advantageous if the mouth of the connection channel arranged in the connection opening of the cylinder/piston unit can be closed by a gate valve entrained by the piston. If, when the material in the device cools and solidifies, the mouth of the connection channel is closed by the gate valve, there is thus no longer a connection between the solidified material in the connection channel of the valve and the material located in the cylinder/piston unit, whereby the pipe section can be lifted off from the cylinder/piston unit, for example for an exchange of the valve, without a high application of force and without the risk of damaging the mouth of the connection channel and/or of the cylinder/piston unit.

The gate valve can be entrained by the piston in a separate guide (inside or outside the cylinder). The gate valve preferably protrudes in the stroke direction of the piston from the effective piston area thereof. The gate valve thus forms a unit with the piston by means of which it is entrained, and there is no need for any additional components, seals or guides.

It is particularly favourable if the screw of the screw unit is axially displaceable and, at its end facing the valve, has a cone seal for sealing with respect to a conical annular shoulder on the inner periphery of the screw unit. By temporarily bringing the cone seal into abutment against the annular shoulder, an additional seal can be achieved during the injection procedure, which for example keeps the thixotropic material inside the screw away from the connection channel as said material cools and away from the material solidifying in the screw. This simplifies a renewed execution of the method after an injection procedure and prevents a material backflow from the valve into the screw unit. Such a seal, in the event of failure of the valve, also protects the screw unit against damage as a result of the injection procedure.

The cone seal, at the tip thereof, particularly preferably carries a tappet, which can be introduced into the connection channel. Such a tappet not only increases the distance between solidifying material in the connection channel and thixotropic material in the screw unit, but, in a manner similar to the gate valve on the side of the cylinder/piston unit of the connection channel, also facilitates the withdrawal, with little force, of the valve from the screw unit, for example in the case of exchange of said valve.

In order to hold the screw in the sealing position of the cone seal thereof against the conical annular shoulder without further energy expenditure, the screw unit may optionally have a bayonet closure for locking the screw in the sealing position thereof.

The entire device can be formed in any position of installation with a screw unit, valve and cylinder/piston unit. It is particularly advantageous if the cylinder/piston unit is arranged approximately horizontally and if the screw unit is arranged approximately vertically: such an arrangement is particularly space-saving and thus facilitates the retrofitting of a conventional die-casting system with die-casting hydraulic system and die-casting mould or the retrofitting of an existing metal injection moulding system with the device according to the present invention. In addition, the screw unit, valve and cylinder/piston unit are easily accessible in this position, and the screw unit can be cleaned or emptied in a gravity-assisted manner by heating the interior of the screw unit above the melting point of the material, such that said material flows off into the injection chamber (for example for renewed injection) when the valve is opened. In addition, the screw unit can thus be fed rather easily at the upper side thereof under the effect of gravity.

At least one stirring element is preferably arranged on the effective piston area of the piston, and the piston can additionally be driven in rotation. The thixotropic material located in the injection chamber can thus be kept moving, which also promotes the homogeneous temperature-control thereof, and, as a result of the selection of the rotational speed, creates an additional possibility for influencing the properties of the thixotropic material. The stirring elements for example can be formed as nubs inclined with respect to the axis of the piston. The aforementioned gate valve may also take on the function of such a stirring element.

It is particularly favourable if the rotary drive of the piston is equipped with means for measuring the torque. It is possible from the measured torque to determine in particular the viscosity and therefore the state of the thixotropic material located in the injection chamber and to thus monitor the process in a more automated and controlled manner and also to monitor the process reliability thereof.

The screw may optionally be provided with an inner heater. A quick, accurate heating of the metal material as it is brought into the thixotropic state within the screw unit is thus possible, whereby the necessary overall length of the entire screw unit is also reduced. Any heater known in the prior art is suitable for this purpose. The inner heater preferably comprises at least one heating coil, which is wound around axially slitted bimetal pipe sections. The heating coil thus contracts in the cold state and can be easily introduced into the screw for assembly and exchange, whereas it expands in the hot state and is thus pressed against the inner face of the screw in close heat-conducting contact.

The screw expediently has at least one inner temperature sensor, via which additional, accurate information concerning the processes inside the screw unit can be obtained in order to control the device.

In a further preferred embodiment of the invention at least two delivery channels for feeding metal material to the screw unit are distributed over the periphery of the screw. It is thus ensured that the screw is filled peripherally uniformly. This avoids a "bridge formation" within the screw cylinder, in which case the screw experiences different friction factors in different zones along the periphery thereof as a result of non-uniform filling, which would impair the uniformity of the thixotropic material.

The screw unit may optionally be formed with at least two screws which rotate in opposite directions and mesh with one another in a gear-like manner. Such an embodiment increases the shear forces which act, as a result of the screw rotation, on the metal material that has been filled into the screw. The thixotropic state of the material is thus more uniform.

In order to better seal off the injection chamber, the piston of the cylinder/piston unit is preferably equipped with at least one piston ring. Piston rings also simplify a lubrication of the piston at it moves in the cylinder, without the risk of a contamination of the thixotropic material in the injection chamber by lubricant.

In a further preferred embodiment of the invention at least one temperature sensor is arranged in the piston of the cylinder/piston unit. A temperature sensor arranged in this way allows a continuous temperature measurement, by contrast with a temperature sensor integrated conventionally into the cylinder wall in accordance with the prior art: during injection, a wall-integrated sensor only delivers temperature data concerning the thixotropic material in the injection chamber until the piston passes over the sensor during the injection procedure. When the piston passes over, a wall-integrated sensor is additionally exposed to high loads as a result of friction; a temperature sensor arranged directly in the piston does not have any of these disadvantages.

At least one pressure sensor may optionally be arranged in the piston of the cylinder/piston unit and allows a continuous measurement of the pressure in the injection chamber in a manner comparable with the temperature sensor integrated in the piston.

It is particularly favourable if the screw unit and/or cylinder/piston unit are equipped with means for forced cooling. The device and the material located therein can thus be cooled quickly, for example during maintenance downtimes or for module exchange, which reduces downtime periods.

In a second aspect the invention also creates a system for die-casting metal material in the thixotropic state, comprising the described device, a die-casting hydraulic system for applying pressure to the piston of the cylinder/piston unit, and a die-casting mould, fed from the cylinder/piston unit, for die-casting metal material in the thixotropic state. A system of this type combines the above-described advantages of the device according to the invention.

In a third aspect, the invention creates a method for die-casting metal material in the thixotropic state, comprising the following steps:

bringing a metal material into the thixotropic state in a screw unit;

bringing the thixotropic material from the screw unit via a connection channel into a cylinder/piston unit;

allowing the material in the connection channel to solidify; and injecting the thixotropic material from the cylinder/piston unit into a die-casting mould whilst the connection channel is blocked by the solidified material therein.

With respect to the advantages of the method according to the invention, reference is made to the previous embodiments of the device.

A preferred embodiment of the method of the invention is characterised by the further step of heating the connection channel until the material located therein is able to flow again for preparation of a renewed execution of the method. The present method can thus be transferred into a highly productive cyclical process with quick cycling.

To further accelerate the cycle times of the method, the material is preferably allowed to solidify by means of forced cooling of the connection channel. Alternatively or additionally, the material can also be allowed to solidify by switching off a heater of the connection channel.

It is particularly advantageous if the thixotropic material is stirred in the cylinder/piston unit before and/or during the injection procedure. As presented, the thixotropic material contained in the injection chamber can thus be kept in the cylinder/piston unit in a uniform state, and the properties of said material can also be changed selectively.

BRIEF DESCRIPTION OF THE DRAWINGS

The invention will be explained in greater detail hereinafter on the basis of an exemplary embodiment illustrated in the accompanying drawings, in which.

DETAILED DESCRIPTION

Figure 1:
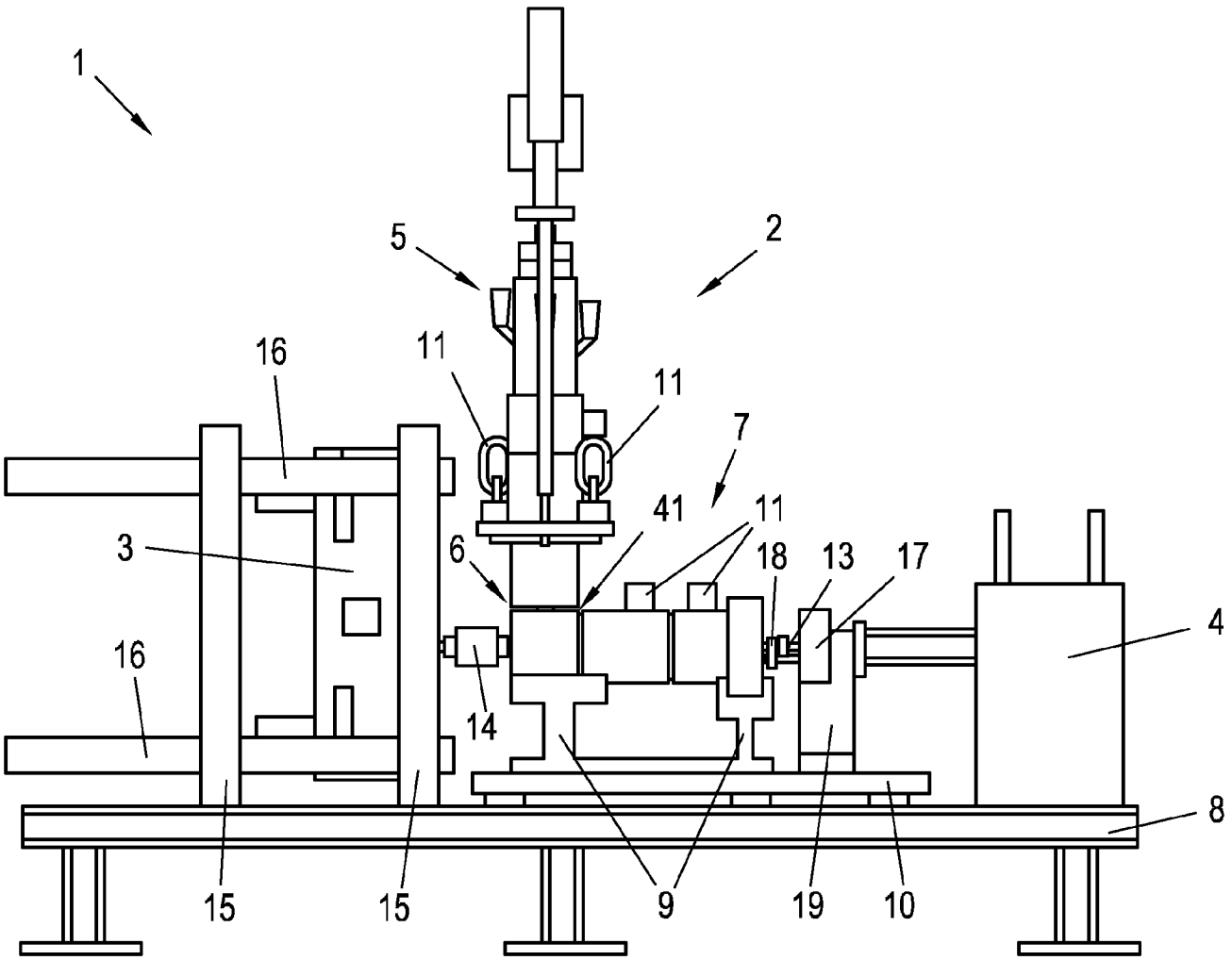
FIG. 1 shows a side view of a metal injection moulding system comprising a device according to the invention.

According to FIG. 1, a metal injection moulding system 1 has a device 2 for die-casting metal materials in the thixotropic state in a die-casting mould 3, a die-casting hydraulic system 4 for applying pressure to the device 2, and an electronic control unit (not illustrated) for process-control of the system 1 as a whole. The system 1 can also be constructed on the basis of a conventional die-casting system, which is modified specifically for metal injection moulding by installing the device 2 between a (conventional) die-casting hydraulic system 4 and a (conventional) die-casting mould 3, possibly also subsequently, in which case the device 2 forms a retrofit kit or adapter kit.

The device 2 comprises an approximately vertical screw unit 5, a valve 6 and an approximately horizontally arranged cylinder/piston unit 7 formed of a piston 7' and cylinder 7". Metal material (not shown) is brought into the thixotropic state in the screw unit 5 and is thereby fed via the valve 6 to the cylinder/piston unit 7. The die-casting hydraulic system 4 then acts on the piston 7' of the cylinder/piston unit 7 in order to inject the thixotropic material from the cylinder/piston unit 7 into the die-casting mould 3.

All parts of the die-casting system 1 are mounted on bearing rails 8. The device 2 sits in an adjustment arrangement 9 on a holding cup 10, and this in turn sits on the bearing rails 8. The adjustment arrangement 9 adapts the position of installation of the device 2 to the die-casting mould 3 and the die-casting hydraulic system 4 in terms of the height and angle; the adjustment arrangement 9 and/or holding cup 10 can be omitted optionally.

Both the screw unit 5 and the cylinder/piston unit 7 have carrying eyes 11. The carrying eyes 11 are used to manipulate the device 2 as a whole, for example when exchanging the device 2 for any other die-casting device or for example for maintenance purposes, or to lift the screw unit 5 from the cylinder/piston unit 7, for example in order to exchange the valve 6.

During the injection procedure, the die-casting hydraulic system 4 actuates the piston 7' of the cylinder/piston unit 7 via a piston rod 13, and thixotropic material is conveyed from the cylinder/piston unit 7 via an injection nozzle 14 to the die-casting mould 3, as will be explained further below in greater detail. The die-casting mould 3, as known in the prior art, is generally formed at least in two parts and is held by a tensioning frame 15 by means of centering bolts 16. To remove a finished diecast shaped part once said part has solidified in the die-casting mould 3, the tensioning frame 15 and die-casting mould 3 are opened at the division thereof in a manner known to a person skilled in the art.

An optional stirring drive 17 drives the piston rod 13 and therefore the piston 7' of the cylinder/piston unit 7 in rotation about the axis thereof via a transmission 18. Here, at least one gearwheel of the transmission 18 may be provided with extra wide teeth to compensate for the axial movements of the piston 7' during die-casting. Another drive known in the prior art, for example a belt drive, but also a direct drive (possibly a hydraulic direct drive) can be used instead of the transmission 18.

A maintenance hydraulic system 19 (likewise optional) is used to move the piston 7' independently of the hydraulic system 4 into a maintenance position 20 (FIG. 3), as explained in detail further below, should this function not be performed by the die-casting hydraulic system 4 itself.

Figure 2:
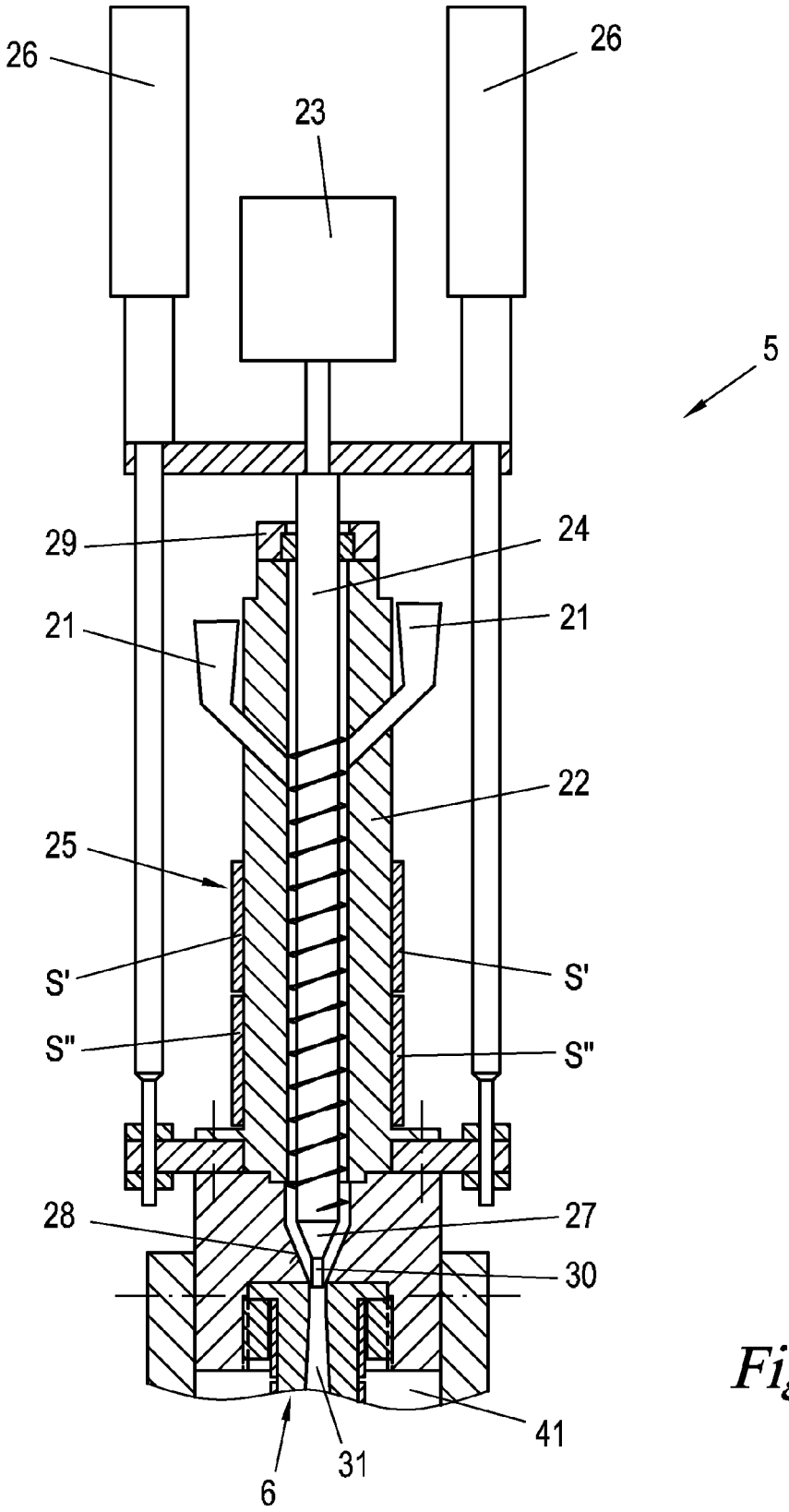
FIG. 2 shows a longitudinal section of the screw unit of the device from FIG. 1.

FIG. 2 shows the screw unit 5 in detail. The screw unit 5 brings metal material into a thixotropic state for preparation for the subsequent die casting. Metal material, for example in granule or chip form, can be fed to the screw unit 5 via funnel-shaped delivery channels 21, which are distributed over the periphery of a screw cylinder 22 and are optionally adapted in terms of their axial position on the screw cylinder 22 to the inclination of the screw. The delivery channels 21 run through the wall of the screw cylinder 22 in a downwardly sloped manner, preferably at an angle between approximately 45° and approximately 60°, which facilitates the uniform feeding.

Apart from metal material, inert gas or another gaseous, liquid and/or solid material can also be fed as required to the screw unit 5 and therefore to the system 1 as a whole. Here, the material may be material that improves the metal injection moulding in terms of the process, for example for grain refinement or flame resistance, or material that influences the properties of the subsequent diecast part, for example for alloying or as a result of introduction of fibres. Inert gas for flame resistance, given its high mass, infiltrates the screw unit 5 and the system 1 due to gravity, wherein it displaces oxidising oxygen located therein, for example.

A screw drive 23 drives a screw 24, which is rotatably mounted so as to be axially displaceable in the screw cylinder 22 and which exerts onto the material the shear forces necessary to bring the material into the thixotropic state. The material in the screw unit 5 is heated via a controllable screw heater 25, encompassing the screw cylinder 22, preferably divided in the direction of the axis of the screw cylinder 22 into at least two segments S', S", and having a design known per se. Here, the segments S', S" can generate different temperature zones in the screw cylinder 22 as a result of selective control.

Due to the action of the shear forces and the heating of the metal material in the screw unit 5, the material is brought into a thixotropic state. At the same time, it is conveyed in the direction of the valve 6 by the movement of the screw 24. Here, the device 2 can be formed such that the screw unit 5 feeds thixotropic material continuously to the cylinder/piston unit 7 via the valve 6, similarly to a conventional extruder. In accordance with FIG. 2, the thixotropic material in the screw unit 5 can alternatively by collected in a preparatory manner in the lower region of the screw cylinder 22 in that the screw 24 in the screw cylinder 22 is moved continuously upwards and brings thixotropic material into the lower region of the screw cylinder 22. This movement can be assisted actively by a screw hydraulic system 26. If, in this case, the intended quantity of thixotropic material is prepared in the screw cylinder 22, said material is thus conveyed into the cylinder/piston unit 7 by the screw 24, acted on by the screw hydraulic system 26, via the valve 6.

As shown in FIG. 2, the screw 24, at the lower end thereof facing the valve 6, may have a cone seal 27 for sealing with respect to a conical annular shoulder 28 on the inner periphery of the screw cylinder 22. With the aid of the screw hydraulic system 26, the screw 24 can be moved into the sealing position thereof (not illustrated) in which it abuts the conical annular shoulder 28 in a sealing manner and can be locked in this sealing position by means of an optional bayonet closure 29. The screw unit 5 can thus be sealed with respect to the valve 6 without further energy expenditure. Instead of the bayonet closure 29, another locking type known in the prior art may also be used.

A cylindrical tappet 30 protruding from the tip of the cone seal 27 can enter the mouth of a central connection channel 31 of the valve 6 in the sealing position of the screw 24. The tappet 30 simplifies the exchange of the valve 6 by distancing any solidified material located therein from the screw unit 5. A valve exchange is thus possible in the cold state without a risk of damage for the screw unit 5 and valve 6. The tappet 30 may alternatively have a different shape adapted to the valve 6 or optionally can be omitted. The conical annular shoulder 28 could also be formed directly in the mouth of the central connection channel 31 of the valve 6.

Alternatively or additionally to the screw heater 25 on the screw cylinder 22, the screw 24 can be equipped with an inner heater (not illustrated), for example an inner heater that is likewise segmented. If such an inner heater is formed as an electrical heater, it may preferably be constructed with heating coils, which are wound around bimetal pipe sections slitted in the axial direction and which are formed such that they can be displaced in the screw 24 in the cold state and can rest fixedly against the inner wall of the screw 24 in the hot state.

The screw 24 optionally has one or more distributed internally arranged temperature sensors (not illustrated). Since the screw rotates, the signal transmission of the temperature sensors and the energy supply of the sensors and the inner heater are to be adapted to the rotational movement. The signal transmission can be performed wirelessly, for example via radio or via slip rings (not illustrated) on the screw 24. The same possibilities exist for the energy supply, wherein the comparatively low energy demand of the temperature sensors can be covered wirelessly or via energy harvesting from the surrounding environment, whereas slip rings are preferred for the inner heater.

Alternatively to the illustration in FIG. 2, the screw unit 5 can also be formed with at least two screws 24, which rotate in opposite directions and mesh with one another in a gear-like manner.

Figure 3:
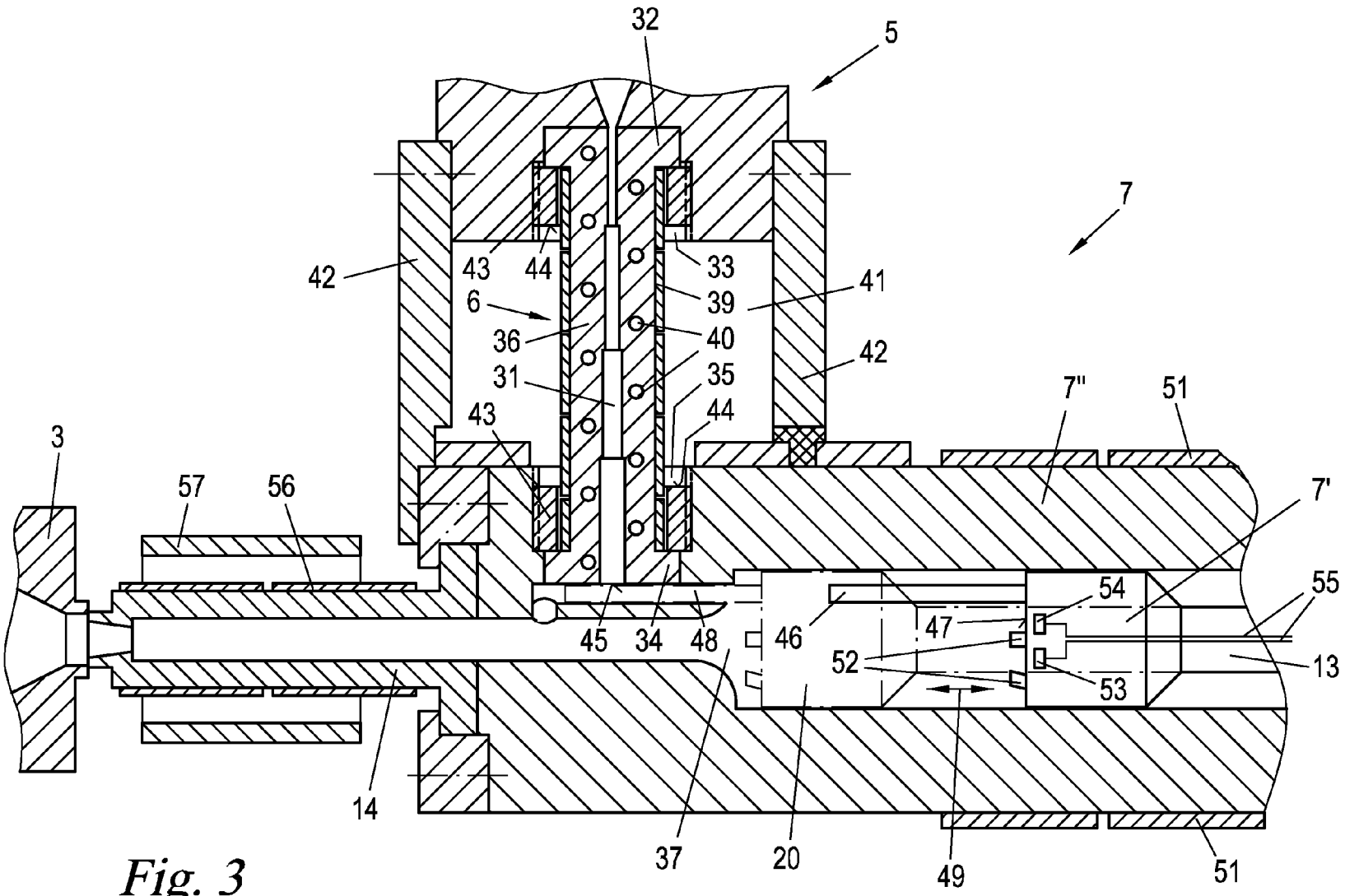
FIG. 3 shows a longitudinal section of the valve and the cylinder/piston unit of the device from FIG. 1.

FIG. 3 shows the valve 6 in detail. The valve 6 is fixed via an upper flange 32 in a connection opening 33 in the screw unit 5 and via a lower flange 34 in a connection opening 35 in the cylinder/piston unit 7. The valve 6 creates a connection for the thixotropic material prepared in the screw unit 5 for feeding the cylinder/piston unit 7 and prevents a backflow of the material from the cylinder/piston unit 7 into the screw unit 5 during the injection. Here, the valve 6 is used in particular to keep the high pressure, created with the injection movement of the piston 7' in the cylinder/piston unit 7, away from the screw unit 5. The valve 6 is formed in accordance with FIG. 3 as a pipe section 36 with a central controllable connection channel 31 for selectively connecting the interior of the screw cylinder 22 to the interior of the cylinder 7" of the cylinder/piston unit 7 serving as an injection chamber 37.

The valve 6 illustrated in FIG. 3 functions thermally and for this purpose has a heatable and/or coolable connection channel 31, which penetrates the pipe section 36 and is optionally widened towards the cylinder/piston unit 7. In FIG. 3 the connection channel 31 is illustrated such that it is widened in a staggered or stepped manner, but alternatively may also be conical (see FIG. 2), conically stepped, conically bulbous, bulbous or simply cylindrical; a number of the above-mentioned forms may also be arranged in succession in the axial direction.

To act on the connection channel 31 thermally and to thereby control the valve 6, said valve is equipped with a controllable heater 39 and/or controllable coolants 40 for forced cooling. By means of the heater 39, material located in the connection channel 31 can be kept in the thixotropic state, and any solidified material located in said connection channel can be made able to flow again in order to "release" the valve 6. Similarly to that described with reference to the screw heater 25, the heater 39 can be divided into segments for zonewise temperature control.

By allowing the connection channel 31 to cool, the material located therein conversely can be made to solidify and then forms a solid plug in the connection channel 31, said plug preventing the passage of material through the connection channel 31 and thus "blocking" the valve 6.

The material in the connection channel 31 can be allowed to solidify by switching off the heater 39 and/or by switching on the coolants 40 for forced cooling. For example, the coolants 40 for forced cooling may comprise gaseous coolant in cooling channels 40 in the pipe section 36.

In order to produce particularly quick cycle times in the case of a cyclical metal injection moulding process, the heater 39 can be formed preferably as an inductive pulse heater, and the coolants 40 for forced cooling can be formed as $CO_2$ gas cooling. Alternatively, other heaters and/or cooling devices known from the prior art can be used for the valve 6.

The heater 39 and/or the coolants 40 for forced cooling can be arranged in or on the wall of the pipe section 36 or in one or more insert cartridges passing for example transversely through the wall of the pipe section 36 and the connection channel 31.

A gap 41 is formed between the screw unit 5 and cylinder/piston unit 7 and is bridged from a thermal point of view only by the valve 6 and thus ensures an extensive thermal decoupling of the screw unit 5 and cylinder/piston unit 7. For additional support of the screw unit 5 on the cylinder/piston unit 7, thermal insulators 42, for example made of ceramic, can be provided.

To fix the valve 6, together with the flanges 32, 34 thereof, in the connection openings 33, 35, threaded rings 43 having outer threads engage with inner threads of the connection openings 33, 35. The threaded rings 43 are preferably cut in the axial direction thereof, whereby they can be handled independently of the valve 6 and, even after their insertion into the connection openings 33, 35, can be placed around the pipe section 36 and can be rotated into the inner thread of the respective connection opening 33, 35.

For the engagement of a tightening or loosening tool, the threaded rings 43 may optionally have corresponding recesses on their exposed engagement faces 44. Buffers (not illustrated) in the slits of the threaded rings 43 prevent said rings from shifting and becoming wedged, since they fill the saw gap created during the production of the threaded rings from a one-piece ring and the subsequent sawing. Alternatively, conventional flange fastenings, for example by means of screwing through bores in the flanges (not illustrated), can be used to fix the valve 6 in the connection openings 33, 35.

The mouth 45 of the connection channel 31 leads directly or, as illustrated, via an auxiliary channel 48 in the wall of the cylinder 7" of the cylinder/piston unit 7 between the piston 7' and injection nozzle 14 into the injection chamber 37 of the cylinder 7". A gate valve 46, which protrudes from the effective piston area 47 of the piston 7', closes the mouth 45 of the valve 6 when the piston 7' is moved into the maintenance position 20 in that said gate valve enters the auxiliary channel 48 and is arranged in front of the mouth 45. The cross section of the gate valve 46 may be round, oval, polygonal or egg-shaped or lenticular, for example, but may also be asymmetrical, and for example may comprise concave segments. The gate valve 46 can alternatively be entrained by the piston 7' via a rod assembly, and may also be guided outside the cylinder 7" or in a separate guide (not illustrated), for example in the wall of the cylinder 7".

The piston movement into the maintenance position 20 is performed by the maintenance hydraulic system 19 generally for maintenance purposes, for example for the exchange of the valve 6; with the injection procedure under normal operating conditions, the piston 7' generally does not move so far as to close the mouth 45 by means of the gate valve 46.

The auxiliary channel 48 is arranged parallel to the stroke direction 49 of the piston 7' and has a cross section adapted to the cross section of the gate valve 46. Alternatively, the auxiliary channel 48 may also have a cross section different from the gate valve 46, provided the gate valve 46 can seal the mouth 45 of the valve 6 with respect to the injection chamber 37. To lead away the material located in the auxiliary channel 48 as the gate valve 46 is retracted, the auxiliary channel 48 is open on both sides towards the injection chamber 37.

When feeding the cylinder/piston unit 7 with thixotropic material from the screw unit 5 via the valve 6 into the injection chamber 37, the piston 7' either moves backwards from the screw unit 5 as a result of the pressure, or is actively moved back by the die-casting hydraulic system 4, wherein it can also assist the screw unit 5 as a result of a suction effect during the feeding process. The thixotropic material is thereby collected in the injection chamber 37 for the now subsequent injection.

In order to ensure the thixotropic state of the material in the injection chamber 37 as best as possible, the cylinder/piston unit has a cylinder heater 51. The cylinder heater 51 is optionally segmented and can be controlled according to zones, similarly to the screw heater 25. To also clean and empty the screw unit 5, the valve 6 and the cylinder/piston unit 7, the screw heater 25, heater 39 and cylinder heater 55 respectively can liquefy the material located in said screw unit, valve and cylinder/piston unit. In addition, the screw unit 5 and cylinder/piston unit 7 can be equipped with coolants for forced cooling, for example in the manner of the coolants 40 for forced cooling of the valve 6, for quick cooling for maintenance and module exchange purposes.

One or more stirring elements 52 can be arranged, additionally to the gate valve 46, on the effective piston area 47 of the piston 7'. The stirring elements 52 for example are nubs inclined with respect to the axis of the piston, but may also be vane-shaped or annular or may have another form suitable for stirring the thixotropic material located in the injection chamber 37, or may also be formed by the gate valve 46 itself.

If the piston 7' is rotated via the piston rod 13 from the stirring drive 17 via the transmission 18, the stirring elements 52 in the injection chamber 37 thus encounter a different resistance depending on the state of the thixotropic material located in said injection chamber. By measuring the torque at the piston rod or in the stirring drive 17, or by means of a separate measuring cell (not illustrated), it is thus possible to determine the state of the thixotropic material in the injection chamber 37.

Further information concerning the state of the thixotropic material located in the injection chamber 37 can be supplied by temperature and pressure sensors in the injection chamber 37. In accordance with FIG. 3, at least one temperature sensor 53 and/or at least one pressure sensor 54 is/are provided in the piston 7'. The signals 55 of the sensors 53, 54 are transmitted for example by the piston rod 13 and possibly, as described above, via slip rings or radio to an externally arranged signal evaluation unit (not illustrated).

If a quantity of material in the thixotropic state sufficient for the subsequent die-casting procedure is present in the injection chamber 37, the valve 6 is closed by switching off the heater 39 and/or switching on the coolants 40 for forced cooling, which prepares the device 2 for the injection of the material into the die-casting mould 3. For injection, the die-casting hydraulic system 4 applies pressure to the piston 7' via the piston rod 13, whereby the thixotropic material is injected from the injection chamber 37 through the injection nozzle 14 into the die-casting mould 3, where it solidifies and can be removed later as a shaped article.

The piston 7' can be provided with one or more piston rings against the inner wall of the cylinder 7" for improved sealing of the injection chamber 37. For example, the piston rings can be formed in a manner known per se as compression rings, of which the contact pressure against the inner wall of the cylinder 7" is provided primarily by the pressure of the thixotropic material in the injection chamber 37, for example via suitable shaping of the compression rings or by additional pressure channels in the piston 7' between the injection chamber 37 and compression rings. A lubrication of the inner wall of the cylinder 7" is also optionally possible; for this purpose, lubricants could be fed for example through lubricant bores in the wall of the cylinder 7" or via the chamber in the cylinder 7" arranged on the side of the piston 7' remote from the die-casting mould 3.

The injection nozzle 14, which leads into the die-casting mould 3, preferably has a nozzle heater 56. The injection nozzle 14, as a result of this, can be formed as what is known as a hot runner in order to prevent a solidification of the material in the interior of said nozzle. FIG. 3 additionally shows an optional insulating sleeve 57 for thermal insulation around the injection nozzle 14. Such an insulating sleeve 57 can also be used in suitable size for thermal insulation of the screw unit 5, the valve 6 and/or the cylinder/piston unit 7.

Once the thixotropic material has been injected into the die-casting mould 3 and the valve 6 has been opened by heating, the method can be performed again.

The invention is not limited to the presented embodiments, but includes all variants and modifications within the scope of the accompanying claims. For example, the mouth 45 of the valve 6 could thus also lead on the side of the piston 7' remote from the die-casting mould 3 into a feed chamber (not illustrated) of the cylinder 7". In this alternative embodiment the screw unit 5 feeds this feed chamber instead of the injection chamber 37 via the valve 6. If the piston 7' then moves back and allows thixotropic material to pass from the feed chamber into the injection chamber 37 via a check valve, the valve 6 can protect the screw unit 5 against the pressure and/or suction effect.

What is claimed is:

1. A device for die-casting metal material, comprising:

a screw unit having a screw cylinder in which a screw is mounted rotatably for exerting onto the material shear forces necessary to bring the material into a thixotropic state; and a cylinder/piston unit fed by the screw unit and having a cylinder in which a piston is movable separately from the screw for applying pressure to the thixotropic material to inject the thixotropic material from the cylinder/piston unit through an injection nozzle into a die-casting mould; wherein a thermally controllable valve is arranged between the screw unit and the cylinder/piston unit, wherein the thermally controllable valve includes a connection channel having a controllable means associated with the connection channel for forced cooling of material located therein until said material is below the solidification temperature thereof, wherein the connection channel widens in the direction from the screw unit to the cylinder/piston unit, and wherein a mouth of the connection channel arranged in a connection opening of the cylinder/piston unit can be closed by a gate valve entrained by the piston of the cylinder/piston unit.

2. The device according to claim 1, wherein the connection channel is equipped with controllable means for heating the material located therein.

3. The device according to claim 1, wherein the screw unit and the cylinder/piston unit form a gap therebetween, said gap, except for thermal insulators, being bridged only by the valve.

4. The device according to claim 1, wherein the gate valve protrudes in the stroke direction of the piston from the effective piston area thereof.

5. The device according to claim 1, wherein the cylinder/piston unit is arranged approximately horizontally, and the screw unit is arranged approximately vertically.

6. The device according to claim 1, wherein the screw unit is provided with a heater.

7. The device according to claim 6, wherein the heater can generate different temperature zones along at least a portion of the length of the screw cylinder.

8. The device according to claim 1, wherein at least one temperature sensor is arranged in the piston of the cylinder/piston unit.

9. A system for die-casting metal material in the thixotropic state, comprising the device according to claim 1, a die-casting hydraulic system for applying pressure to the piston of the cylinder/piston unit, and a die-casting mould fed from the cylinder/piston unit for die-casting metal material in the thixotropic state.

10. A device for die-casting metal material, comprising:

a screw unit having a screw cylinder in which a screw is mounted rotatably for exerting onto the material shear forces necessary to bring the material into a thixotropic state; and a cylinder/piston unit fed by the screw unit and having a cylinder in which a piston is movable separately from the screw for applying pressure to the thixotropic material to inject the thixotropic material from the cylinder/piston unit through an injection nozzle into a die-casting mould; wherein a thermally controllable valve is arranged between the screw unit and the cylinder/piston unit, wherein the thermally controllable valve includes a connection channel having a controllable means associated with the connection channel for forced cooling of material located therein until said material is below the solidification temperature thereof, wherein the connection channel widens in the direction from the screw unit to the cylinder/piston unit, and further wherein the screw of the screw unit is axially displaceable and, on its side facing the valve, has a cone seal for sealing with respect to a conical annular shoulder on the inner periphery of the screw unit.

11. The device according to claim 10, wherein the controllable valve is formed by a connection channel, which is equipped with controllable means for forced cooling of the material located therein until said material is below the solidification temperature thereof, and wherein the cone seal, at the tip thereof, carries a tappet which can be introduced into the connection channel.

12. The device according to claim 10, wherein the connection channel is equipped with controllable means for heating the material located therein.

13. The device according to claim 10, wherein the screw unit and the cylinder/piston unit form a gap therebetween, said gap, except for thermal insulators, being bridged only by the valve.

14. The device according to claim 10, wherein the screw unit is provided with a heater.

15. The device according to claim 14, wherein the heater can generate different temperature zones along at least a portion of the length of the screw cylinder.

16. A system for die-casting metal material in the thixotropic state, comprising the device according to claim 10, a die-casting hydraulic system for applying pressure to the piston of the cylinder/piston unit, and a die-casting mould fed from the cylinder/piston unit for die-casting metal material in the thixotropic state.

17. A device for die-casting metal material, comprising:

a screw unit having a screw cylinder in which a screw is mounted rotatably for exerting onto the material shear forces necessary to bring the material into a thixotropic state; and a cylinder/piston unit fed by the screw unit and having a cylinder in which a piston is movable separately from the screw for applying pressure to the thixotropic material to inject the thixotropic material from the cylinder/piston unit through an injection nozzle into a die-casting mould; wherein a thermally controllable valve is arranged between the screw unit and the cylinder/piston unit, wherein the thermally controllable valve includes a connection channel having a controllable means associated with the connection channel for forced cooling of material located therein until said material is below the solidification temperature thereof, wherein the connection channel widens in the direction from the screw unit to the cylinder/piston unit, and further wherein at least one stirring element is arranged on an effective piston area of the piston, and the piston can additionally be driven in rotation.

18. The device according to claim 17, wherein a torque measured at a rotary drive of the piston determines a state of the thixotropic material in an injection chamber of the cylinder/piston unit.

19. The device according to claim 17, wherein the connection channel is equipped with controllable means for heating the material located therein.

20. The device according to claim 17, wherein the screw unit and the cylinder/piston unit form a gap therebetween, said gap, except for thermal insulators, being bridged only by the valve.

21. The device according to claim 17, wherein the screw unit is provided with a heater.

22. The device according to claim 21, wherein the heater can generate different temperature zones along at least a portion of the length of the screw cylinder.

23. A system for die-casting metal material in the thixotropic state, comprising the device according to claim 17, a die-casting hydraulic system for applying pressure to the piston of the cylinder/piston unit, and a die-casting mould fed from the cylinder/piston unit for die-casting metal material in the thixotropic state.

24. A method for die-casting metal material in a thixotropic state, comprising:

bringing the metal material into the thixotropic state in a screw unit by exerting onto the material shear forces with a screw rotatably mounted in a screw cylinder, feeding the thixotropic material from the screw unit into a cylinder/piston unit via a connection channel, wherein the connection channel widens in the direction from the screw unit to the cylinder/piston unit; and wherein the cylinder/piston unit has a cylinder in which a piston is movable separately from the screw of the screw unit, allowing the material located in the connection channel to solidify as a result of forced cooling of the connection channel until said material is below the solidification temperature thereof, injecting the thixotropic material from the cylinder/piston unit through an injection nozzle into a die-casting mould by applying pressure to the thixotropic material with the piston whilst the connection channel is blocked by the solidified material therein, and wherein the thixotropic material is stirred in the cylinder/piston unit before and/or during the injection procedure.

25. The method according to claim 24, further comprising heating the connection channel until the material located therein is able to flow again for preparation of a renewed execution of the method.

26. The method according to claim 24, wherein the material is allowed to solidify by switching off a heater of the connection channel.

* * * * *